United States Patent [19]

Tanaka et al.

[11] 4,358,265

[45] Nov. 9, 1982

[54] COMBUSTION APPLIANCE WITH A SAFETY DEVICE

[75] Inventors: Eiichi Tanaka, Yamatokoriyama; Koro Furumai, Ikomo; Masahiro Indo, Tenri; Norio Kawabata, Nara, all of Japan

[73] Assignee: Matsushita Electric Industrial Co., Ltd., Kadoma, Japan

[21] Appl. No.: 156,196

[22] Filed: Jun. 3, 1980

[30] Foreign Application Priority Data

Jun. 15, 1979 [JP] Japan ..... 54/76133
Aug. 20, 1979 [JP] Japan ..... 54/106344

[51] Int. Cl.[3] ..... F23N 5/24

[52] U.S. Cl. ..... 431/76; 73/27 R; 236/15 E

[58] Field of Search ..... 431/42, 76, 75; 236/15 E; 126/116 A, 351; 122/504; 200/61.03; 73/23, 27 R; 204/195 S, 1 T; 340/577, 579; 338/34

[56] References Cited

U.S. PATENT DOCUMENTS 3,971,344 7/1976 Gouyou-Beauchamps ..... 122/504
4,032,286 6/1977 Kobayashi et al. ..... 431/76
4,125,356 11/1978 Ohashi et al. ..... 431/76
4,138,881 2/1979 Isenberg ..... 73/27 R
4,221,557 9/1980 Jalies ..... 431/22
4,234,542 11/1980 Romine ..... 338/34
4,249,156 2/1981 Micheli ..... 338/34

FOREIGN PATENT DOCUMENTS 2461565 6/1976 Fed. Rep. of Germany ..... 431/76
54-6143 1/1979 Japan ..... 431/76

OTHER PUBLICATIONS

"Combustion Sensor" National Technical Report vol. 24, No. 3, Jun. 1978 (Japan).

*Primary Examiner*—Samuel Scott
*Assistant Examiner*—Lee E. Barrett
*Attorney, Agent, or Firm*—Wenderoth, Lind & Ponack

[57] ABSTRACT

There is provided a combustion appliance with a safety device. An oxygen partial pressure sensor made up of a transition metal oxide or rare earth metal oxide is normally disposed in a position in which the excess air ratio downstream of a flame formed by a burner can be detected and, at times of abnormality, within the flame. The resistance change of said oxygen partial pressure is detected and the combustion is stopped when incomplete combustion occurs due to oxygen depression, clogging of the primary air orifice of the burner or clogging of the combustion chamber with the products of combustion.

4 Claims, 8 Drawing Figures

COMBUSTION APPLIANCE WITH A SAFETY DEVICE

BACKGROUND OF THE INVENTION

1. Field of the Invention

This invention relates to a combustion appliance equipped with a safety device which is adapted to suspend the supply of fuel to a burner means of the combustion appliance not only when the oxygen concentration of ambient air has dropped so as to cause an oxygen insufficiency but also before incomplete combustion develops owing to a clogging of a primary air orifice of the burner means or a linting of fins, for example of a water heater, and to thereby prevent carbon monoxide poisoning.

2. Description of the Prior Art

The hitherto-available safety devices for combustion appliances include a flame failure detecting device for preventing leakage of raw gas and an oxygen insufficiency safety device which has recently been a subject of great interest. The general principle underlying said flame failure detecting device is to detect the presence or absence of a pilot flame with a thermocouple and, in this field of art, a variety of improvements have been proposed. Oxygen insufficiency safety devices are also available which, through various burner constructions, are designed to detect a reduction of oxygen concentration of the air from a change of flame temperature before the emission of carbon monoxide gas takes place from a main burner as the oxygen concentration decreases. Although the above devices are capable of precluding evolution of carbon monoxide gas because the combustion range of the burner is restricted in response to a reduction of the oxygen concentration of ambient air, they fail to deal effectively with situations in which the appliance after having remained unused for long has been locally clogged with dust, oil or the like or the burner orifices have been clogged.

One solution proposed to the above problems is a method of suspending the supply of fuel gas in such a manner that when, for example, the fins of a heat exchange device such as a water heater have been linted, the pressure gain within the heat exchanger is fed back to the primary air orifice of the pilot burner so as to dilute the primary air with the products of combustion in the heat exchanger and the resultant change of the pilot burner flame prior to cause evolution of carbon monoxide due to linting of the fins is detected so as to stop the supply of fuel.

This method is able to deal with the problem associated with linted heat exchanger fins but is unable to deal successfully with such problems as the clogging of the primary air orifice of the burner.

Another device previously proposed and capable of dealing with the problem of oxygen insufficiency or a clogged primary air orifice is one incorporating a combustion sensor which utilizes an oxygen ion conductive solid electrolyte (for example, zirconium oxide). This combustion sensor includes an electrode disposed on either side of the sensor and is adapted to generate an electromotive force between the two electrodes when a difference of oxygen concentration develops between the two sides of the sensor.

In order that such a sensor may function as a system responsive to oxygen reduction or a clogging of the primary air orifice, the burner is preferably such that the flame length is short and that all the air required is supplied in a premixed form, i.e. the burner is of the total premixed combustion type. Since such a total premixed combustion burner is so designed that, in normal combustion, an amount of air in excess of the theoretical air amount is usually supplied as primary air, the combustion product gas still contains a small percent of oxygen and it is also so designed that, by the provision of one electrode on this combustion product side and the other electrode on the atmospheric side, only a small electromotive force will be generated between the electrodes. Then, when the amount of oxygen relative to that of fuel becomes in short supply at times of oxygen reduction or at the time of clogging of the primary air orifice, there is available an oxygen concentration of only about $10^{-10}$ at the electrode on the combustion product side and an oxygen concentration of about ten and same percent on the atmospheric side and, due to this difference in oxygen concentration, a large electromotive force is generated between the two electrodes. The generation of this electromotive force is sensed to detect an occurrence of oxygen insufficiency or a clogging of the primary air orifice. However, since the device is such that it detects an oxygen concentration gradient between the electrodes, the choice of positions of the sensor components with respect to the flame is limited. Thus, in order to position one electrode on the combustion product gas side and the other on the atmospheric side, the flame must preferably be short and even. Moreover, while the device is suitable for sensing if all the air requirement is being met by primary air, that is to say if the current combustion is total premixed combustion, it is disadvantageous, when the flame is long and tends to sway as in the case of a busen flame, in that because the sway of the flame becomes large at times, the electrode opposite to the one on the combustion product gas side is brought into a condition similar to that of the on the combustion product gas side so that at the time of oxygen reduction or at the time of clogging of the primary air orifice, the difference in oxygen concentration between the two electrodes is reduced to almost nil and, hence, no electromotive force is generated therebetween. The net result is that the device fails to detect the abnormality.

OBJECT AND SUMMARY OF THE INVENTION

The object of this invention is to provide a combustion appliance with a safety device including an oxygen partial pressure sensor which is disposed downstream of a flame formed by a burner means of said combustion appliance in a normal state of affairs but within the flame in an abnormal state, the resistance change of said oxygen partial pressure sensor being detected. This arrangement protects against raw gas contamination and carbon monoxide poisoning, irrespective of burner types and of modes of combustion, and not only at times of oxygen insufficency, i.e. when the atmosphere in the room has been contaminated with combustion products, but also at times of incomplete combustion in the burner due to clogging with oil and other foreign matter which occurs during prolonged use of the appliance.

DETAILED DESCRIPTION OF THE INVENTION

Figure 1:
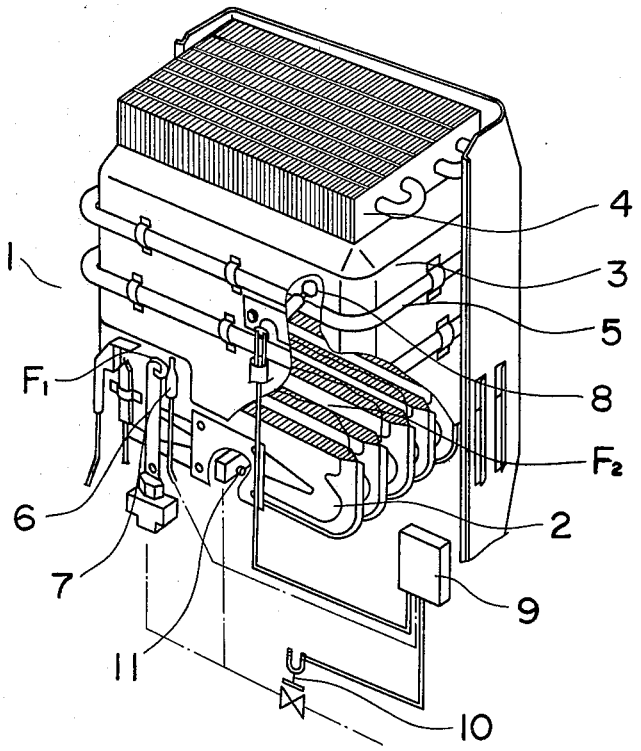
FIG. 1 is a partially cut away perspective view showing a combustion appliance with a safety device according to one embodiment of this invention.
Figure 2:
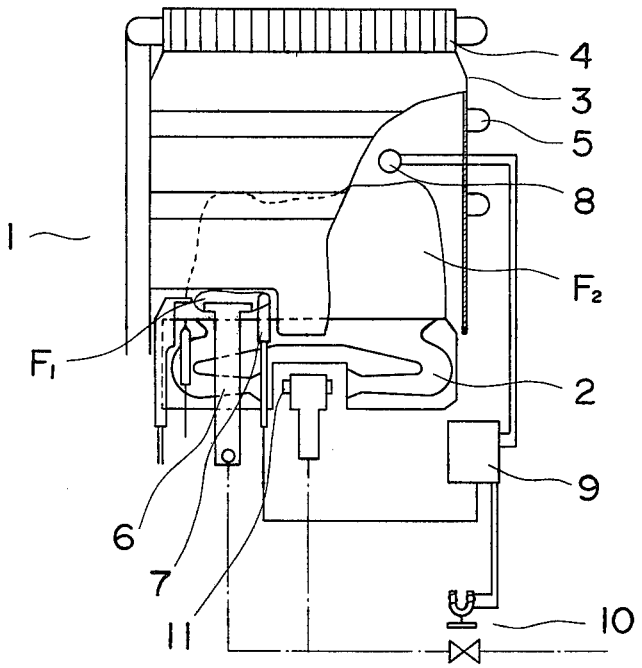
FIG. 2 is a front view of the appliance depicted in FIG. 1.

Referring to FIGS. 1 and 2, which illustrates this invention as embodied in a water heater, the reference numeral (1) generally designates a water heater body and (2) a burner means thereof.

The water heater further includes a combustion chamber (3) which, in accordance with this invention, doubles as a heat exchanger [hereinafter, the heat exchanger will also be designated by the reference numeral (3)].

The heat exchanger (3) includes a finned portion (4) at an upper end thereof, said finned portion (4) being rigidly connected to a pipe for water and hot water supply (5). The reference numeral (6) indicates a pilot burner. There is also provided a probe (7) for sensing a flame $F_1$ which is generated by said pilot burner (6). Indicated at (8) is an oxygen partial pressure sensor which is employed according to this invention. The oxygen partial pressure sensor is disposed downstream of the flame formed by said main burner (2) and in a position from which the excess air ratio within said combustion chamber (3) when the flame is in a normal state can be detected but within the above-mentioned flame at a time when the flame is abnormal. In accordance with this invention, said oxygen partial pressure sensor (7) is located below said finned portion (4). Signals from said probe (7) and oxygen partial pressure sensor (8) are fed to an electronic circuit (9). The electronic circuit (9) is connected to a means (10) (a solenoid valve (10) in this embodiment) for stopping the supply of fuel. The reference numeral (11) designates a nozzle of the main burner (2).

The oxygen partial pressure sensor (8) employed according to this invention is a sintered ceramic body of a transition metal oxide, e.g. $TiO_2$, $V_2O_5$, $Cr_2O_3$, $MnO_2$, $Fe_2O_3$, NiO, CoO, etc. or of rare earth metal oxide, e.g. $CeO_2$, $Pr_6O_{11}$, etc. and is provided with a couple of electrodes spaced apart by the oxide. The resistance between the two electrodes changes with a variation in oxygen partial pressure of the ambient atmosphere to be sensed in the high temperature range of 600° to 900° C.

The operation of the above appliance will be described hereinafter.

On manipulation of a push-and-turn cock (not shown), for instance, the fuel gas is ignited to produce the flame $F_1$ at the pilot burner (6). This flame $F_1$ is sensed by the probe (7) and the output detection signal is fed to the electronic circuit 9 so as to drive the solenoid valve and, hence, open a gas circuit. Then, the flame $F_1$ of the pilot burner (6) propagates to the main burner (2), whereupon a flame $F_2$ is generated in the main burner (2) for regular combustion. Once this state of regular combustion is established, the oxygen partial pressure sensor (8) located below the finned portion (4) of the heat exchanger (3) is heated, with its resistance reaching several tens of KΩ to several hundreds of KΩ (the sensor resistance when the flame is extinguished is several tens of MΩ) and thus indicating that the main burner (2) is in a stable combustion state.

After the ignition of the main burner (2), a switching takes place in the electronic circuit (9) so that the state of combustion is now detected by the oxygen partial pressure sensor (8), not by said probe (7). While complete combustion is the usual state of affairs, what takes place during incomplete combustion will be explained with reference to FIGS. 3 and 4. By way of example, if combustion is maintained for a long time in an ill-ventilated room, the atmospheric air in the room is contaminated with combustion product gases, with a consequent reduction in oxygen concentration of the atmospheric air which, in turn, causes the appliance to undergo incomplete combustion, generating a large quantity of carbon monoxide (CO) gas. At such times, the flame $F_2$ is elongated to the extent that the oxygen partial pressure sensor (8) positioned below the finned portion (4) of heat exchanger 3 is enshrouded by the flame so that the resistance of the sensor (8) drops from several hundreds of Ω to tens of Ω.

Therefore, by setting the cut-off point of said solenoid valve (10) at an appropriate level (for example, several KΩ to hundreds of Ω), the occurence of incomplete combustion can be detected.

Figure 3:
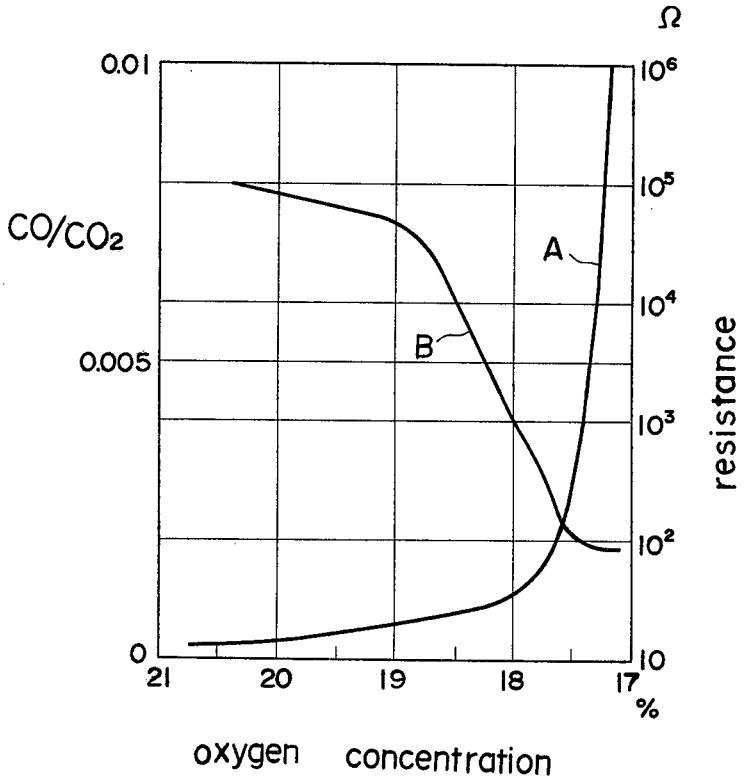
FIG. 3 is a graph showing the oxygen insufficiency characteristic of the appliance illustrated in FIG. 1.

FIG. 3 is a graph showing this rising CO evolution and the change of resistance of the oxygen partial pressure sensor (8) as plotted against oxygen concentration. In the figure, the line A represents the $CO/CO_2$ ratio and the line B represents the electrical resistance of oxygen partial pressure sensor (8).

A large amount of CO is evolved when any abnormality occurs in the appliance, for example when the supply of air to its burner is reduced due to plugging of the air orifice or linting of the finned portion (4) of heat exchanger 8 due to prolonged use.

Figure 4:
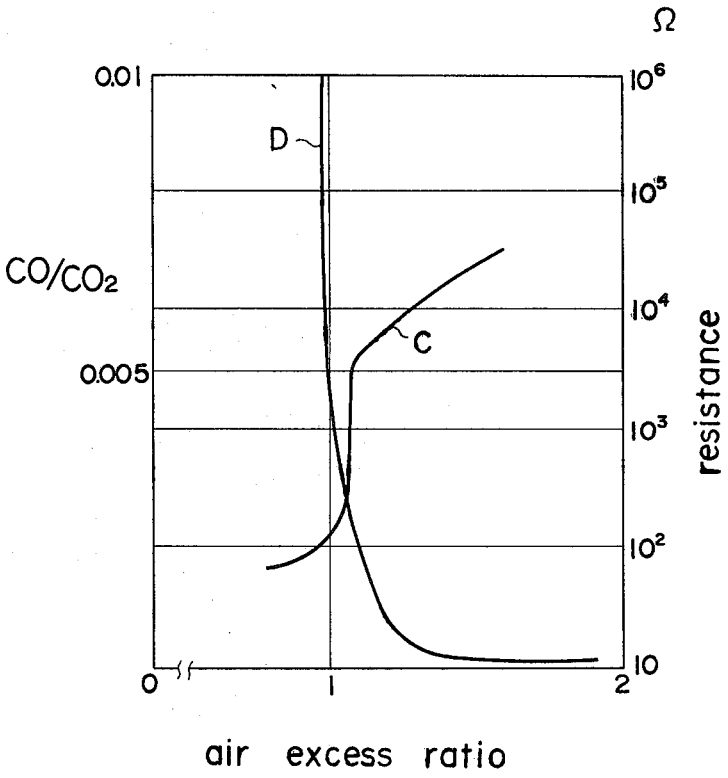
FIG. 4 is a graph showing the air excess characteristic of the appliance illustrated in FIG. 1.

FIG. 4 illustrates such a state of affairs. Thus, in a normal state of combustion, combustion takes place and proceeds with an air excess ratio of about 1.5 to 2.0 and as represented by the line C, and the electrical resistance of the oxygen partial pressure sensor (8) lies between tens of KΩ and hundreds of KΩ, showing that a stable combustion state is being maintained. However, if the supply of air to the main burner 2 drops due to clogging of the appliance with dust, oil etc., the air excess ratio decreases and as the amount of air supply becomes less than theoretical air amount, there takes place an incomplete combustion which produces a large amount of CO as indicated by the line D. In such a state of affairs, the electrical resistance of the oxygen partial pressure sensor (8) drops to tens of Ω to hundreds of Ω, indicating that the current combustion state is abnormal and causing the solenoid valve 10 to close just as in the case of CO evolution due to a reduction of oxygen concentration of the air.

Figure 5:
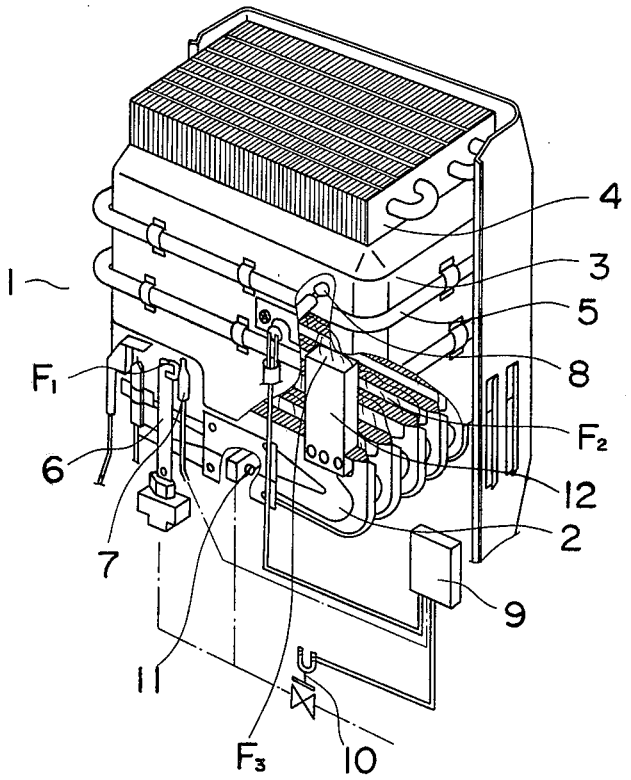
FIG. 5 is a partially cut away perspective view showing another combustion appliance with a safety device according to this invention.
Figure 6:
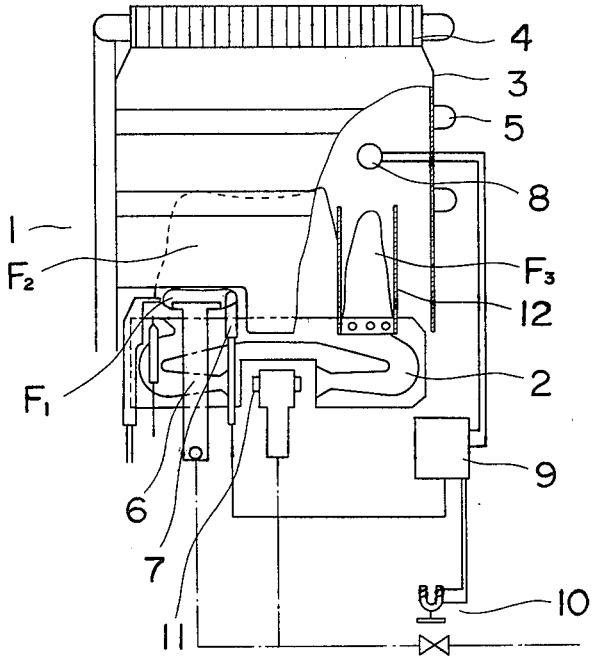
FIG. 6 is a fragmentary front view of FIG. 5.

FIGS. 5 and 6 show another embodiment of this invention which is adapted for an early detection of CO evolution. Thus, an oxygen partial pressure sensor (8) which is like that described for the first embodiment is disposed downstreams of a flame $F_3$ formed at a shelter 12 for restricting the secondary air in a part of the main flame $F_2$ and in a position where the excess air ratio of said flame $F_3$ can be detected. In accordance with this invention, the shelter (12) is secured to the main burner to provide an integral unit.

Figure 7:
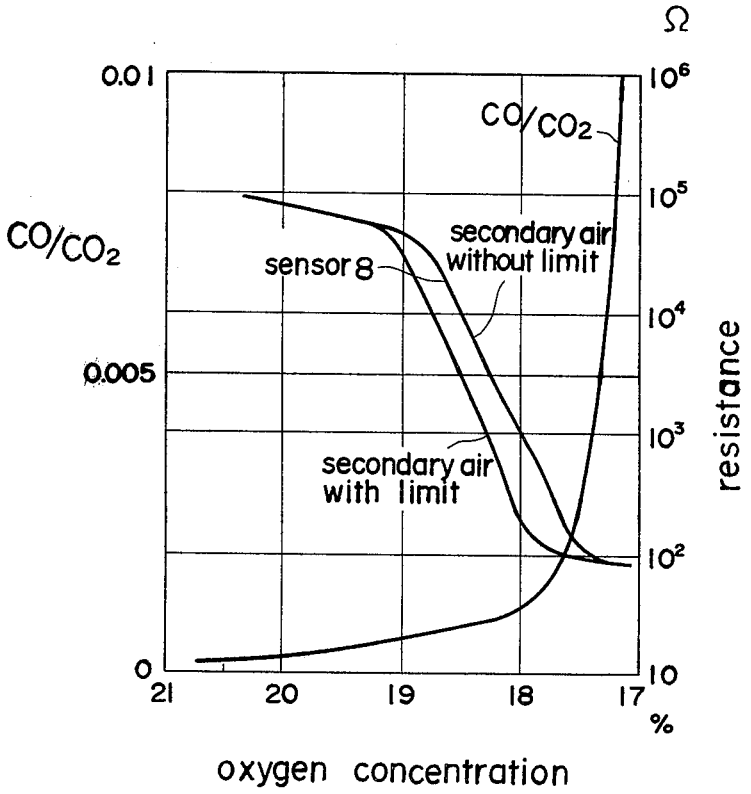
FIG. 7 is a diagram showing the oxygen depression characteristic of the appliance illustrated in FIG. 5.

While the operation of this embodiment is similar to that of the first embodiment, what takes place on occurence of incomplete combustion will be explained below with reference to FIGS. 7 and 8.

If combustion is allowed to continue for hours in an ill-ventilated room, for instance, the air in the room is contaminated with combustion products so that the oxygen concentration of the air will be progressively reduced. As a consequence, the flame $F_3$ with a limited supply of secondary air is gradually elongated and, ultimately, the flame $F_3$ impinges on the finned portion, whereby a large quantity of CO is generated. In this state of affairs, the oxygen partial pressure sensor (8) disposed below the finned portion (4) of heat exchanger and downstreams of the flame $F_3$ at the shelter 12 for restricting the secondary air is enshrouded by the elongated flame $F_3$ before the flame end bombards the finned portion (4), so that the resistance of the sensor (8) drops to hundreds of ohms to tens of ohms. Then, as the oxygen reduction is further aggravated, the flame $F_2$ is also brought into a state of incomplete combustion but since by this time the solenoid valve (10) will have been closed by a signal from said oxygen partial pressure sensor (8) through the electronic circuit (9), an early institution of the safety measure is ensured. FIG. 7 is a graph showing the increase of CO evolution and the change of resistance of the oxygen partial pressure sensor (8) as plotted against oxygen concentration. The graph shows the difference which is dictated by whether a secondary air restrictive shelter is present or not.

A large quantity of CO is evolved when the supply of air to the burner is limited due to an abnormality such as the clogging of the air orifice of the appliance burner, linting of the heat exchanger fins, etc.

Figure 8:
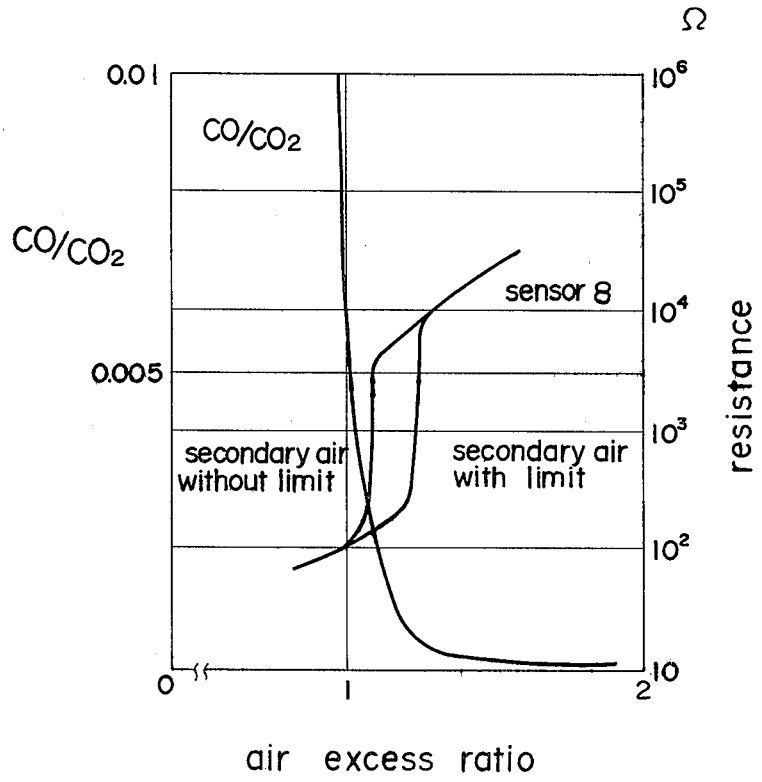
FIG. 8 is a graph showing the air excess characteristic of the appliance illustrated in FIG. 5.

FIG. 8 is a graph showing such a state of affairs. Thus, normal combustion proceeds with an air excess ratio of about 1.5 to 2.0 and the resistance of the oxygen partial pressure lies between tens KΩ and hundreds of KΩ, thus showing that a stable combustion state is being maintained. However, as the appliance becomes clogged with dust, oil, etc., the supply of air to the burner is limited. Consequently, at first, the air excess ratio in the neighbourhood of the oxygen partial pressure sensor (8), where the air supply is limited, drops to less than 1 and the resistance of the sensor (8) drops to tens of Ω to hundreds of Ω, indicating that an abnormal condition is being developed. In this state of affairs, the flame $F_2$ in the zone not subject to the above-mentioned secondary air limitation is still in a normal combustion state so that the total amount of evolution of CO is almost nil. Stated differently, the abnormality is detected at a very early time so that maximum safety is assured. FIG. 8 is a graph representing the above state of affairs and showing the difference between the detection of the overall air excess ratio and the detection of the air excess ratio in the zone of limited secondary air supply.

It should be understood that although, in the two embodiments described above, an appliance having a pilot burner (6) and a main burner (2) is provided with a temperature probe (7) near the pilot burner and an oxygen partial pressure sensor (8), this invention can be applied to appliances which are not equipped with pilot burner means (6), such as direct main burner ignition type devices. It should also be understood that although the above two embodiments are concerned with water heaters, this invention can be successfully applied to such combustion appliances as stoves wherein the oxygen partial pressure sensor (8) may be disposed downstream of the flame formed by the burner and in a position from which the air excess ratio of said flame can be sensed under normal conditions, and within the flame formed by said burner at times of abnormal conditions.

Therefore, this invention is applicable not only to gas combustion appliances described herein but also to appliances burning petroleum-based and other fuels.

It will be apparent from the above description that this invention can be applied to combustion appliances irrespective of the type of burner with which such appliances are equipped.

Moreover, it is no longer necessary to carry out a complicated procedure to detect the oxygen concentration gradient with electrodes installed at two positions.

The oxygen partial pressure sensor described herein is made of the oxide of a transition metal such as titanium oxide or the like, but it may be made of any other material having similar characteristics or materials the electrical resistance characteristic of which is the reverse of the air ratio, i.e. materials which have lower resistances when the air supply is larger than theoretical air and higher resistances when the amount of available air is smaller than theoretical.

What is claimed is:

1. A combustion appliance with a safety device comprising:

a combustion chamber;

a burner means in said combustion chamber;

an oxygen partial pressure sensor comprised of a sintered ceramic body of a transition metal oxide or rare earth metal oxide the resistance of which varies in response to the oxygen partial pressure of the ambient atmosphere in which the sensor is positioned, said oxygen partial pressure sensor being positioned in said combustion chamber downstream of said burner means and at a distance from said burner means for, when the flame formed by said burner means is that for normal combustion, being spaced from the flame and, when the flame is elongated due to an oxygen deficiency, for being enveloped by the flame; and means connected to said oxygen partial pressure sensor for stopping the supply of fuel to said burner means in response to an output signal from said oxygen partial pressure sensor indicating an oxygen deficiency.

2. A combustion appliance with a safety device as claimed in claim 1 wherein said appliance includes means for providing a supply of secondary air, and said burner means has a shelter for restricting the secondary air supply to a portion of the flame formed by said burner means, and said oxygen partial pressure sensor being positioned downstream of the position of the portion of the flame the secondary air to which is restricted by said shelter.

3. A combustion appliance with a safety device as claimed in claim 2 wherein said burner means comprises a main burner and said shelter is integral with said main burner.

4. A combustion appliance with a safety device as claimed in claim 1, 2 or 3 wherein said combustion chamber has therein a heat exchanger equipped with a finned portion and said oxygen partial pressure sensor is between said burner means and said finned portion.

* * * * *